US007255510B2

(12) United States Patent
Bougamont

(10) Patent No.: US 7,255,510 B2
(45) Date of Patent: Aug. 14, 2007

(54) ROTATING DISPENSER FOR LIQUID COSMETICS

(75) Inventor: Jean-Louis Bougamont, EU (FR)

(73) Assignee: Rexam Dispensing Systems S.A.S. (FR)

( * ) Notice: Subject to any disclaimer, the term of this patent is extended or adjusted under 35 U.S.C. 154(b) by 0 days.

(21) Appl. No.: 11/252,161

(22) Filed: Oct. 17, 2005

(65) Prior Publication Data

US 2006/0071034 A1 Apr. 6, 2006

Related U.S. Application Data

(63) Continuation of application No. PCT/EP2004/004023, filed on Apr. 15, 2004.

(30) Foreign Application Priority Data

Apr. 15, 2003 (EP) ..... 03290936

(51) Int. Cl.
*B43K 1/06* (2006.01)

(52) U.S. Cl. ..... 401/265; 401/277; 401/175; 401/263

(58) Field of Classification Search ..... 401/262, 401/263, 265, 269, 270, 272, 274, 277, 280, 401/281, 172–175, 178, 179, 182; 222/390
See application file for complete search history.

(56) References Cited

U.S. PATENT DOCUMENTS 1,403,426 A * 1/1922 Loeben ..... 222/387
2,997,078 A * 8/1961 Gainer ..... 141/383

FOREIGN PATENT DOCUMENTS

| | | |
|---|---|---|
| EP | 0 258 799 | 3/1988 |
| FR | 1 414 640 | 10/1965 |
| FR | 1 529 772 | 6/1968 |
| FR | 2 001 789 | 10/1969 |
| FR | 2 718 110 | 10/1995 |

OTHER PUBLICATIONS

International Search Report, PCT, Jul. 7, 2004, 3 pages.

* cited by examiner

*Primary Examiner*—Huyen Le
(74) *Attorney, Agent, or Firm*—St. Onge Steward Johnston & Reens LLC

(57) ABSTRACT

A liquid cosmetic product dispenser includes mainly a reservoir, an internal piston and an applicator nozzle provided with an end valve. The reservoir consists of a base provided with an axial rod on which the piston can move longitudinally by rotating the base in relation to the nozzle.

9 Claims, 5 Drawing Sheets

ROTATING DISPENSER FOR LIQUID COSMETICS

This application is a continuation of International Patent Application No. PCT/EP2004/004023 filed on Apr. 15, 2004 which designates the United States and claims priority from European Patent Application No. 03290936.8 filed on Apr. 15, 2003.

FIELD OF THE INVENTION

The present invention relates to a dispenser of liquid cosmetic products.

More precisely, the invention is applicable to products such as mainly gels and the liquid lipsticks known as lip-gloss, which are currently replacing traditional products that come in solid or paste form.

BACKGROUND OF THE INVENTION

As regards lip-gloss, the difference in density and viscosity between traditional products and the new products make the telescopic stick dispensers unusable and require a modification of the distribution and application means in order to fulfil the conditions of dosage, watertightness and protection of the product.

Liquid product dispensers already exist of the types that comprise a reservoir, an internal piston and an application nozzle, generally provided with a valve.

However, for marketing reasons, it is important to preserve, at least partly, the overall appearance of the traditional packaging in order to avoid an abrupt break with the make-up habits of the users. In particular, it seems essential to perpetuate the use of a rotary movement for delivering the product.

And yet, due to the fluidity of the product, resorting to such a movement poses mainly watertightness and dispensing problems.

It is necessary, mainly, to guarantee the hermetic seal of the dispenser using an end valve that does not have any kind of retention area in which a residual volume of the product would be at a risk of remaining and drying up.

SUMMARY OF THE INVENTION

The aim of the present invention is to solve these problems in a satisfactory manner.

This aim is achieved, according to the invention, by means of a dispenser characterised in that the said reservoir consists of a base provided with an axial rod on which the said piston can be moved longitudinally by rotation of the said base in relation to the said nozzle.

According to an advantageous embodiment of the invention, the said valve comprises a central pin that is able to hermetically seal an evacuation orifice arranged through a wall made on the end of the nozzle.

According to a first alternative, the said pin is formed integral with the end of the axial rod.

According to a second alternative, the said pin is formed integral with a cover intended to cover the said nozzle.

According to a third alternative, the said pin is formed integral with an internal sleeve that surrounds the said piston inside the nozzle.

Preferably, the said sleeve extends into the base by means of an internal jacket.

If required, the perimeter of the said jacket can be provided with locking systems that work with complementary systems made on the internal wall of the base.

According to another characteristic, the said piston is made up of a collar screwed onto the axial rod and extending downwards by means of a cylindrical flange provided at its bottom end with a peripheral lip in watertight contact with the internal wall of the base.

According to yet another characteristic, the said piston is guided in an axial translation movement by rotation-blocking systems made on the radially surrounding walls.

In parallel, the axial rod is provided with threaded sectors that provide the screwing of the piston while allowing the product to pass through.

Preferably, the nozzle and the base are assembled in a watertight manner with their edges touching.

Another objective of the invention is a method for manufacturing and assembling a liquid cosmetic product dispenser comprising mainly a base forming a reservoir, an internal piston provided with a collar and an applicator nozzle, characterised in that, on the one hand, a collar made on the said piston is made from moulding a flexible and elastic material and, on the other hand, an axial rod made in the said base and threaded is made from moulding a hard, rigid material, and then the rod is axially inserted by force into the said collar such as to become meshed with the rod by anchoring of the thread set in the collar.

The dispenser of the invention has a general appearance and ergonomics that are very similar to those of traditional lipsticks, even though it has very different functional elements which are adapted to the nature of the liquid product, to its physical properties and to the small doses that need to be dispensed.

In addition, the watertightness of the dispenser and the way in which the product is dispensed are perfectly compatible with the constraints that relate to liquid cosmetics.

The dispenser of the invention also has a very simple structure with a possible alternative that has only two parts and which therefore has a particularly inexpensive cost price.

Finally, the packaging of the product and mainly the filling of the dispenser are carried out easily with all the possible embodiments of the invention, benefiting from the position and the structure of the end valve, which enables ventilation.

BRIEF DESCRIPTION OF THE SEVERAL VIEWS OF THE DRAWING

The invention will be better understood from reading the following description made in reference to the appended diagrams in which FIGS. 1A and 1B respectively show an axial cross-section view of an embodiment of the dispenser of the invention and a transverse cross-section view along line II of the axial rod of the collar.

DETAILED DESCRIPTION OF DRAWINGS

Figure 1A:
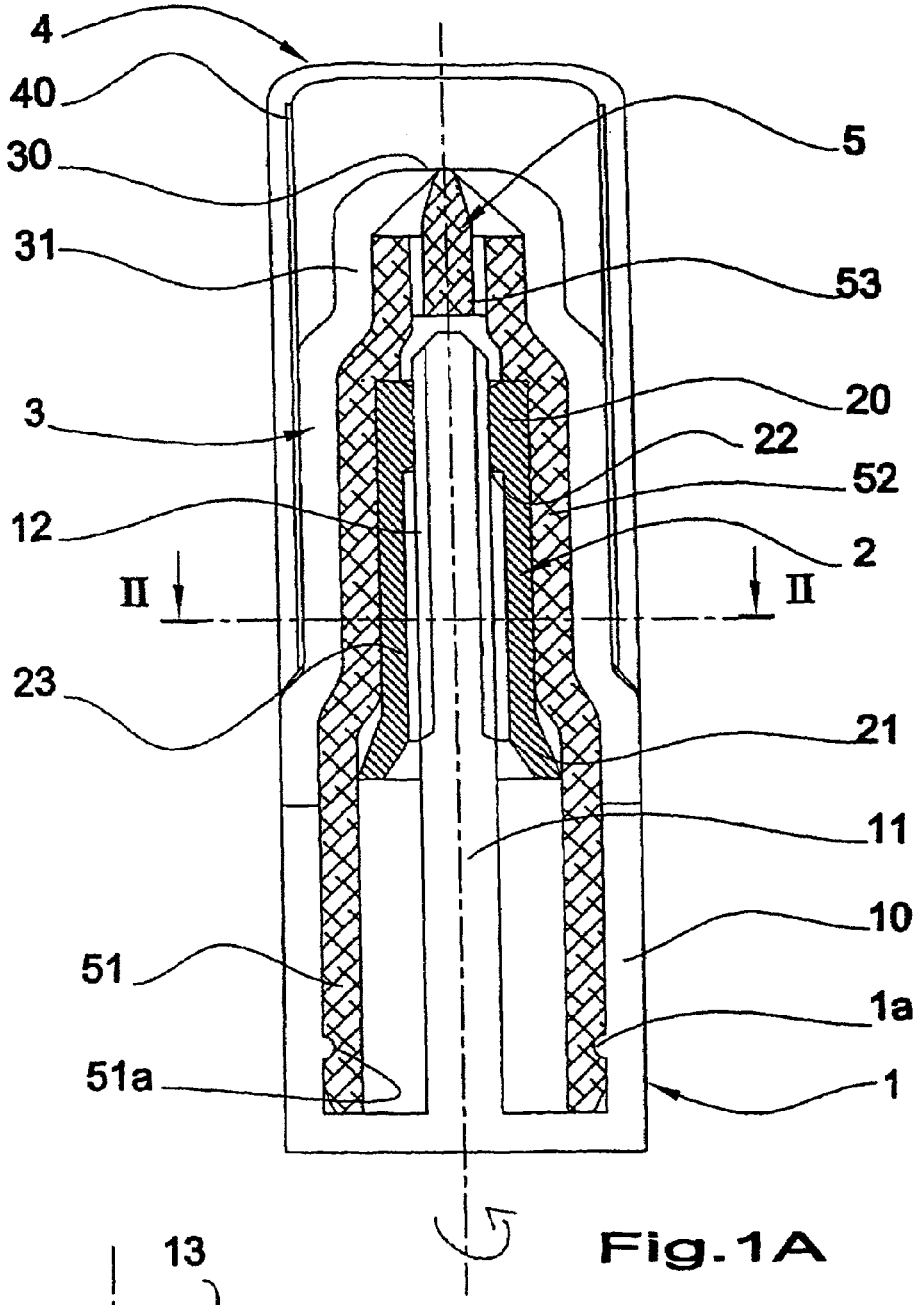
Figure 1B:
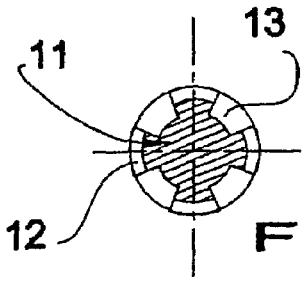

The dispenser shown in FIG. 1A is designed for packaging and dispensing a liquid cosmetic product such as a cream or even lip-gloss.

It comprises a reservoir 1, an internal piston 2, an applicator nozzle 3 provided with a valve and a protective cover 4.

The cover is provided, if required, with restraint and blocking fins 40 that work with the nozzle 3.

According to the invention, the reservoir consists of a substantially cylindrical base 10 provided with an axial rod 11.

The piston 2 is mounted on the projecting part of the rod 11. The piston 2 can move axially along this rod by manual rotation of the base 1 in relation to the nozzle 3 in order to exert a pressure on the product.

For this purpose, the rod 11 is provided with threaded sectors 12 that allow the piston 2 to be screwed on and also allow the product to pass through in the direction of the valve, the sectors 12 being separated along the length of the rod 11 by gorges 13 that extend at least along the entire threaded height of the rod 11.

In the shown embodiments of the invention, the piston 2 moves from the top down but it is possible to plan, by symmetry, an inverse operation by prolonging the threaded part of the rod 11 downwards and fitting the piston onto the rod in the opposite direction.

The nozzle 3 and the base 1 are assembled in a watertight manner with their edges touching.

Figure 2A:
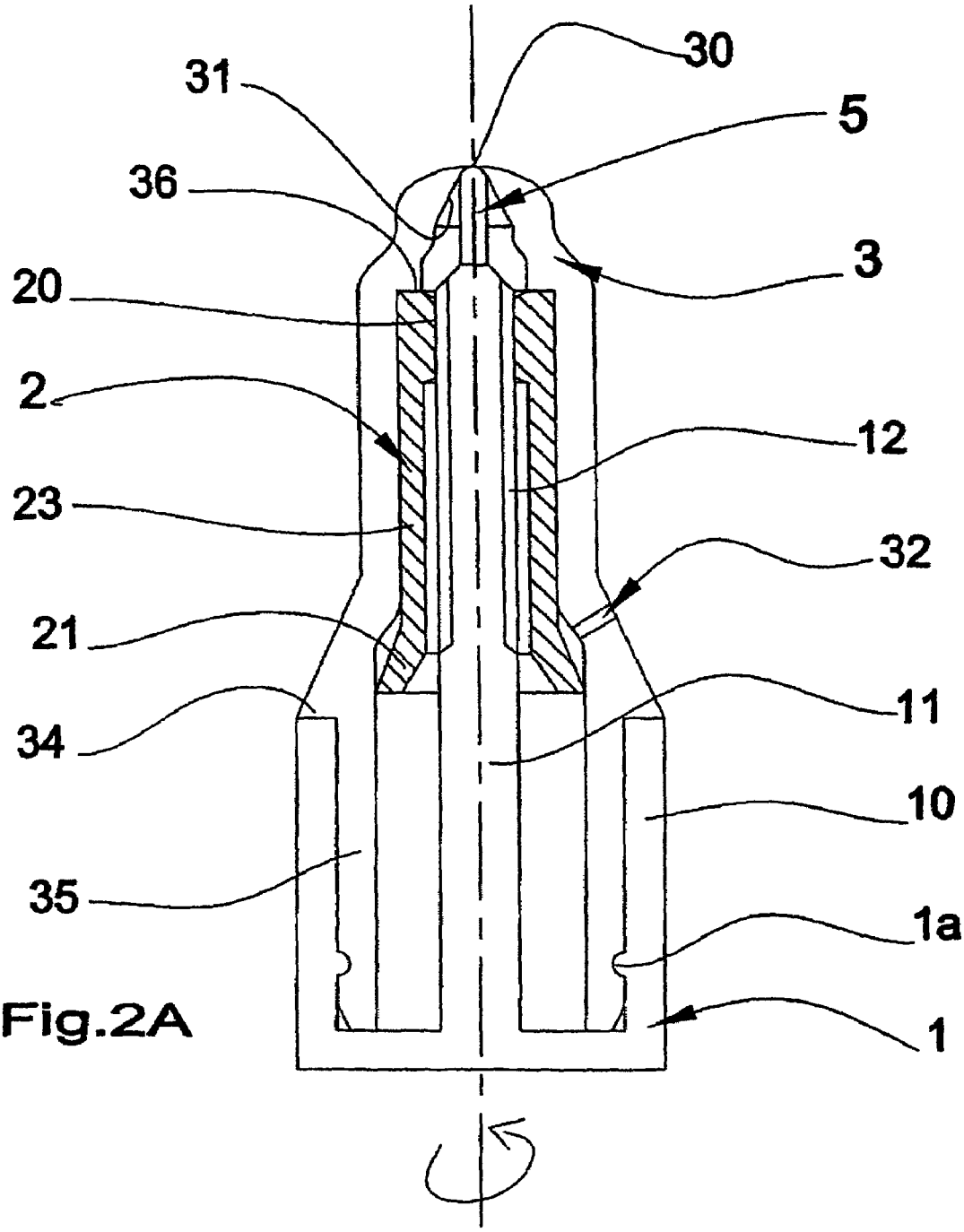
FIGS. 2A and 2B respectively show an axial cross-section view of a first alternative embodiment of the dispenser shown in FIG. 1A with the piston in the high position and in the low position, after draining the reservoir.
Figure 3:
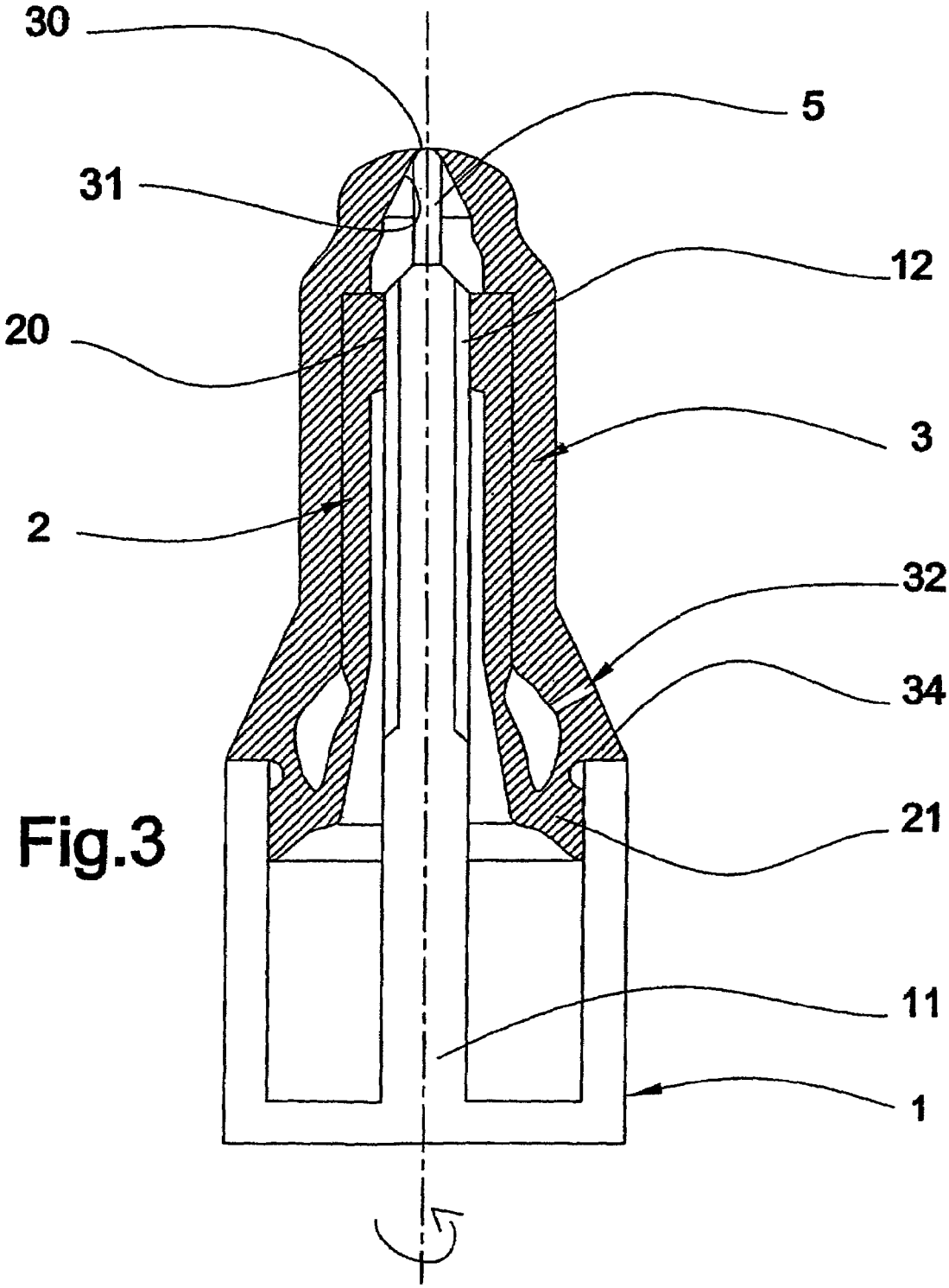
FIG. 3 shows an axial cross-section view of a second embodiment of the dispenser of the invention.

In the embodiment of the invention shown in FIGS. 1A, 2A and 3, the nozzle 3 comprises, at least at its end, an elastically distortable wall 31 through which an evacuation orifice 30 is made.

The wall 31 is intended for application of the product, for example, lip-gloss, on the lips of the user and has for this purpose an ogival curvilinear profile as shown in the figures, or any other shape that is suitable for this purpose.

Preferably, according to the materials chosen, the wall 31 will be thinner than the average thickness of the side wall of the nozzle to increase its flexibility and reinforce the watertightness.

The nozzle 3 is associated to an end valve that guarantees, in the closed position, the watertightness of the distributor and, in the open position, a regular and even supply of the product to the application wall 31.

This valve comprises a pin 5 forming a nozzle needle that is able to hermetically seal the orifice 30.

In the embodiment of the invention shown in FIG. 1A, the pin 5 is formed integral with an internal coaxial sleeve 52 that surrounds the piston 2 inside the nozzle 3 and is extended by an internal jacket 51 which lines the wall of the base 1.

The pin 5 is connected to the sleeve 52 by spacers 53 that between them delimit passages for the product.

Figure 2B:
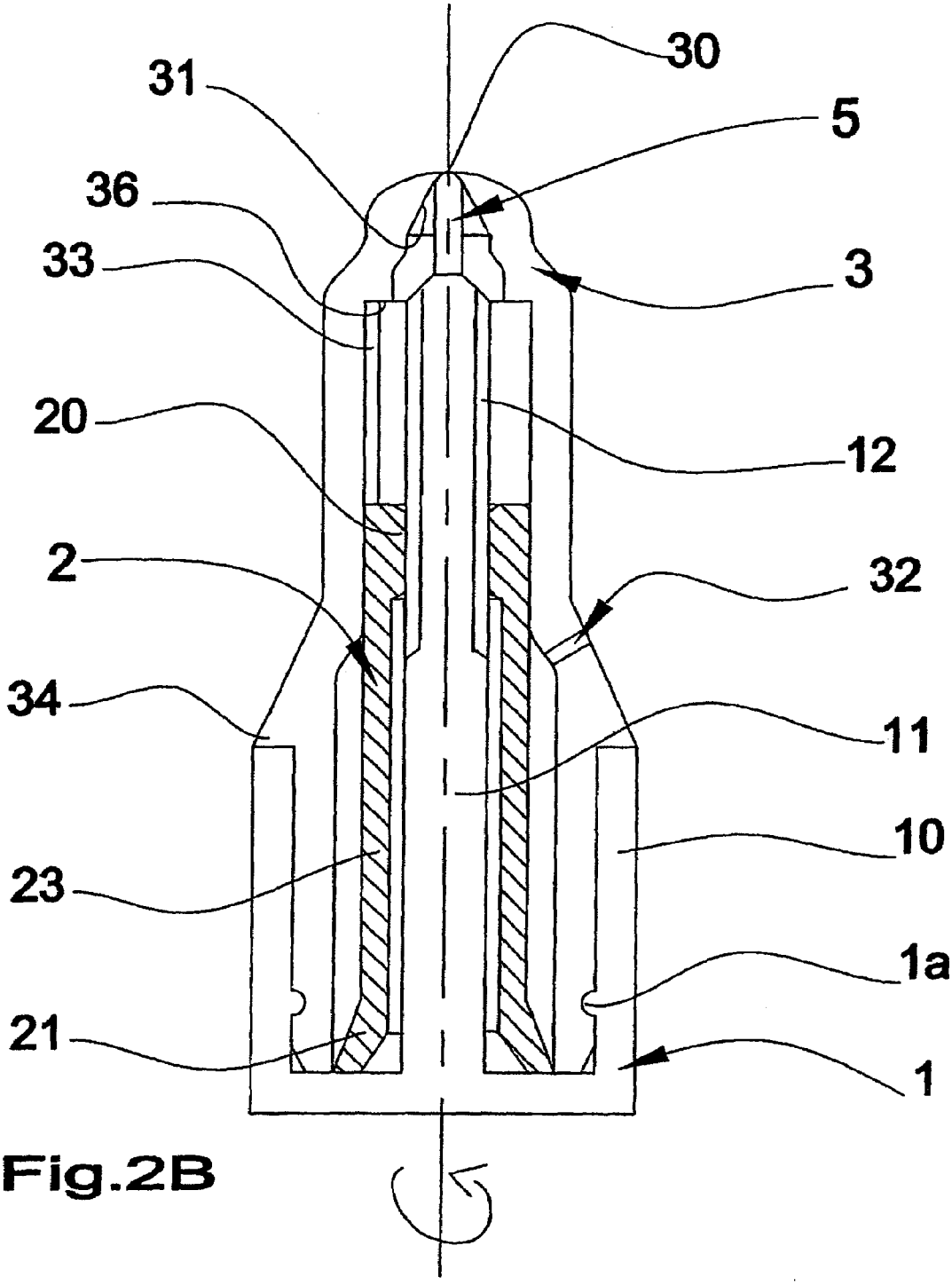

In the embodiment of the invention shown in FIGS. 2A, 2B and 3, the pin 5 is directly formed integral with the end of the rod 11 and no internal sleeve is provided. However, for watertightness reasons, the side wall of the nozzle 3 is then extended into the base 1 either by a skirt 35 (FIG. 2A) or by a lip 21 (FIG. 3) and comprises a shoulder 34 that also forms a stop for the upper edge of the base and for the cover 4.

Figure 4:
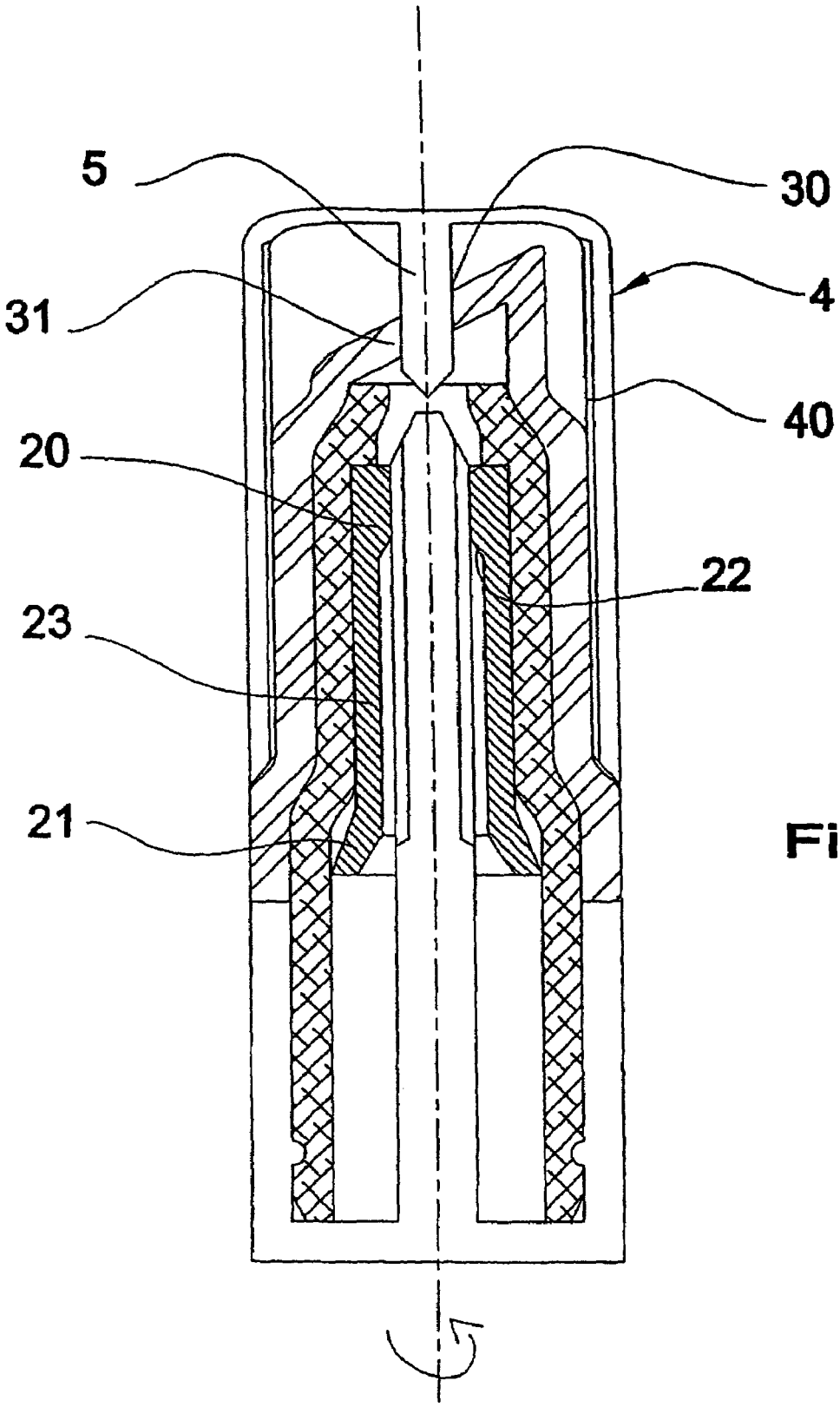
FIG. 4 shows a partial axial cross-section view of a third alternative embodiment of the dispenser of the invention.

In the embodiment of the invention shown in FIG. 4, the pin 5 is made on the bottom of the cover 4 and obstructs the orifice 30 from the outside. In this figure, the product-application wall 31 is slanted in the manner of a paintbrush.

In FIG. 1A, the bottom perimeter of the jacket 51 is provided with locking systems 51*a* that work with complementary systems made on the wall of the base.

The piston 2 consists, at the top, of a collar 20 screwed onto the rod 11 and extended via a chamfer 22 by a cylindrical flange 23 and provided, at the bottom, with a peripheral lip 21 which here comes into hermetic sliding contact with the wall of the jacket 51.

The flange 23 has a widened inner diameter and thus delimits, with the rod 11, below the collar 20 and as a complement to the gorges 13, a space where the product can circulate in the direction of the end valve.

It is necessary to block the rotation of the piston 2 in order to obtain only a guided axial movement along the rod 11.

For this purpose, the piston 2 is provided, if required, with systems for blocking its rotation working with complementary systems made in the radially surrounding walls, which are, in FIG. 1A, those of the sleeve 52 and, in FIGS. 2A and 2B, those of the nozzle 3.

These systems can be made, as shown in FIG. 2B, for example, in the form of a set of longitudinal ribs 33 made respectively in the opposing walls of the piston 2 and the nozzle 3 and coming up against each other or being lodged in one or several matching grooves in the opposite part.

In every case, the dimensions and, in particular, the diameters of the piston 2 and the rod 11, are determined with the aim of reducing the dead volume between the said piston and the internal wall of the nozzle 3 as much as possible.

Likewise, the proportions between the pin 5, the rod 11 and the nozzle 3 will be determined such as to minimise the initial volume located between the piston 2 and the end valve.

The nozzle 3 (or the sleeve 52) is provided, at the top, with an internal stop 36 for axial positioning of the piston 2 for its prior insertion in the nozzle 3 (or the sleeve 52) in inverted position, before assembly with the base 1.

Preferably, the piston 2 will come, at least locally, into hermetic sliding contact with the internal wall of the sleeve 52 or of the nozzle 3 due to the expansion of the collar 20 that results from the screwing action on the rod 11.

The peripheral lip 21 of the piston 2 generally has a tapered profile. In the alternative shown in FIG. 3, the lip 21 is connected to the end of the nozzle 3, which is bent inwards to form the piston.

Indeed, in this alternative, the nozzle 3 and the piston 2 are initially made from a single part, the nozzle being an upper extension of the piston.

Then, during the assembly, the piston 2 is turned towards the inside of the nozzle 3 where it is held in place by its terminal part which forms a collar on the end of the rod 11.

However, it is possible in this last alternative to provide a linking area with a hinge effect between the parts of the piston 2 and the nozzle 3 for facilitating the return of the flange.

The rotation of the base 1 in the set direction (possibly by means of backstop teeth or ratchets) and in relation to the nozzle 3 (or to the sleeve 52 formed integral with the nozzle 3—FIG. 1A), transmits an axial translation movement to the piston 2, by means of the threaded sectors 12, which compresses the product. The product then passes through the centre of the dispenser, in the gorges 13 between the sectors 12 (and, in FIG. 1A, also via the passages between the spacers 53) in the direction of the end valve.

Under the pressure of the product, the wall 31 distorts elastically and opens the orifice 30 around the pin 5 thus allowing the product to escape towards the outside. When the pressure stops, the wall returns to its initial position and the pin 5 returns to its hermetic position in the orifice 30.

In order to compensate, if necessary, for the vacuum created by the product being released, it is possible to provide a ventilation conduit 32 in the wall of the nozzle 3 or of the sleeve 52, above the level of the lip 21 of the piston 2.

Evidently, the height of the piston 2 will be determined by to the height to which the product is stored inside the base 1 in order to be able to dispense the largest possible volume of product.

The nozzle 3 and the piston 2 are made from flexible thermoplastic materials, which are preferably elastic, or from elastomers, while the base 1 and the sleeve 52 are made from plastic materials that are harder and more rigid.

All the parts that make up the dispenser of the invention can be manufactured by means of an injection or bi-injection moulding procedure. Bearing in mind the nature of the materials used, the dispenser can be assembled by direct axial insertion of the rod 11 of the base 1 in the piston 2 (with prior reversal in the case shown in FIG. 3), benefiting from the guide offered by the wall of the nozzle 3.

In addition, it is not necessary to make any kind of a threaded section on the piston 2, insofar as the tightening of the elastic flexible collar 20, between the nozzle 3 or the sleeve 52, on the one hand, and the meshing on the rigid threaded sectors 12, on the other hand, is enough on its own to produce an anchoring of the thread set in the collar and to form an impression in order to guarantee the transmission of the rotation movement.

Likewise, with the embodiment of the invention shown in FIG. 1A, it is not necessary to provide rotation-blocking systems on the piston itself since the blocking systems made in the internal wall opposite the rigid sleeve 52 can prevent the rotation of the piston and provide an axial guide by simple sinking of the flange 23 in the flexible material of the wall.

What is claimed is:

1. A dispenser of a liquid cosmetic product comprising mainly a reservoir, an internal piston and an applicator nozzle provided with an end valve, the said reservoir consisting of a base provided with an axial rod on which the said piston can move longitudinally by rotation of the said base in relation to the said nozzle, characterised in that the said valve comprises a central pin formed integral with an internal sleeve surrounding the said piston inside the nozzle and which is able to hermetically block an evacuation orifice made through a wall made on the end of the nozzle.

2. A dispenser according to claim 1, characterised in that the said pin is formed integral with the end of the axial rod.

3. A dispenser according to claim 1, characterised in that the said pin is formed integral with a cover intended for covering the said nozzle.

4. A dispenser according to claim 1, characterised in that the said sleeve extends into the base by means of an internal jacket.

5. A dispenser according to claim 4, characterised in that the perimeter of the said jacket is provided with locking systems that work with complementary systems made on the inner wall of the base.

6. A dispenser according to claim 1, characterised in that the said piston is made up of a collar screwed onto the axial rod and extended downwards by means of a cylindrical flange provided on its bottom end with a peripheral lip in hermetic sliding contact with the internal wall of the nozzle.

7. A dispenser according to claim 1, characterised in that the said piston is guided in an axial translation movement by rotation-blocking systems made in the radially surrounding walls.

8. A dispenser according to claim 1, characterised in that the said axial rod is provided with threaded sectors that provide the screwing of the piston while allowing the product to pass through.

9. A dispenser according to claim 1, characterised in that the nozzle and the base are assembled in a watertight manner with their edges touching.

* * * * *